US009873986B2

(12) United States Patent
Zhu et al.

(10) Patent No.: US 9,873,986 B2
(45) **Date of Patent: *Jan. 23, 2018**

(54) PAPER-MAKING AID COMPOSITION AND PROCESS FOR INCREASING ASH RETENTION OF FINISHED PAPER

(71) Applicant: Ecolab USA Inc., St. Paul, MN (US)

(72) Inventors: Bo Zhu, Shenyang (CN); Na Xu, Shanghai (CN); Meng Zhang, Shanghai (CN); Yulin Zhao, Shanghai (CN)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/021,490

(22) PCT Filed: Sep. 12, 2014

(86) PCT No.: PCT/US2014/055415

§ 371 (c)(1),
(2) Date: Mar. 11, 2016

(87) PCT Pub. No.: WO2015/038905

PCT Pub. Date: Mar. 19, 2015

(65) Prior Publication Data

US 2016/0230346 A1 Aug. 11, 2016

(30) Foreign Application Priority Data

Sep. 12, 2013 (CN) ..... 2013 1 0413579

(51) Int. Cl.
*D21H 17/37* (2006.01)
*D21H 21/18* (2006.01)

(52) U.S. Cl.
CPC ..... *D21H 21/18* (2013.01); *D21H 17/375* (2013.01)

(58) Field of Classification Search
CPC ..... D21H 21/18; D21H 17/37; D21H 17/375
USPC ..... 162/164.6
See application file for complete search history.

(56) References Cited

U.S. PATENT DOCUMENTS

| | | | |
|---|---|---|---|
| 3,556,932 | A | 1/1971 | Coscia et al. |
| 4,251,651 | A | 2/1981 | Kawakami et al. |
| 4,605,701 | A | 8/1986 | Guerro et al. |
| 5,674,362 | A | 10/1997 | Underwood et al. |
| 5,783,041 | A | 7/1998 | Underwood |
| 5,981,044 | A | 11/1999 | Phan et al. |
| 6,179,962 | B1 | 1/2001 | Brady et al. |
| 6,246,874 | B1 | 6/2001 | Staib et al. |
| 6,294,645 | B1 | 9/2001 | Allen et al. |
| 6,723,204 | B2 | 4/2004 | Van Handel et al. |
| 6,824,650 | B2 | 11/2004 | Lindsay et al. |
| 7,641,766 | B2 | 1/2010 | St. John et al. |
| 7,767,059 | B2 | 8/2010 | Ryan et al. |
| 7,883,603 | B2 | 2/2011 | Hund et al. |
| 7,897,013 | B2 | 3/2011 | Hagiopol et al. |
| 7,901,543 | B2 | 3/2011 | St. John et al. |
| 7,972,478 | B2 | 7/2011 | Hund et al. |
| 2006/0037727 | A1 | 2/2006 | Hagiopol et al. |
| 2006/0065380 | A1 | 3/2006 | Garnier et al. |
| 2008/0216979 | A1 | 9/2008 | Schaffer |
| 2010/0190948 | A1 | 7/2010 | Proverb et al. |
| 2011/0155339 | A1 | 6/2011 | Brungardt et al. |
| 2012/0103548 | A1 | 5/2012 | Zhao et al. |
| 2012/0118523 | A1 | 5/2012 | Lu et al. |
| 2012/0186764 | A1 | 7/2012 | McKay |
| 2013/0081771 | A1 | 4/2013 | Luo et al. |
| 2016/0230346 | A1 | 8/2016 | Zhu et al. |

FOREIGN PATENT DOCUMENTS

| | | | |
|---|---|---|---|
| CA | 2690863 | A1 | 12/2008 |
| CN | 101778873 | A | 7/2010 |
| CN | 102050915 | A | 5/2011 |
| EP | 0678528 | A1 | 10/1995 |
| EP | 1456472 | | 9/2004 |
| JP | 54-30913 | A | 3/1979 |
| JP | 58-4898 | A | 1/1983 |
| JP | 1-49839 | B2 | 10/1989 |
| JP | 2-307998 | A | 12/1990 |
| JP | 2934284 | B2 | 8/1996 |
| JP | 9-105097 | A | 4/1997 |
| JP | 2001-279595 | A | 10/2001 |
| JP | 2001-279599 | A | 10/2001 |
| JP | 3273534 | B2 | 4/2002 |
| JP | 2003-73991 | A | 3/2003 |
| JP | 2004-11059 | A | 1/2004 |
| JP | 2004-300629 | A | 10/2004 |
| JP | 2005-15975 | A | 1/2005 |
| JP | 2005-154966 | A | 6/2005 |
| JP | 2005-226200 | A | 8/2005 |
| JP | 2005-336646 | A | 12/2005 |
| JP | 2006-138029 | A | 6/2006 |
| JP | 2007-126770 | A | 5/2007 |
| JP | 2007-126771 | A | 5/2007 |
| JP | 2007-126772 | A | 5/2007 |
| JP | 4352587 | B2 | 10/2009 |
| JP | 4556191 | B2 | 10/2010 |
| WO | WO 96/38629 | A1 | 12/1996 |
| WO | WO 97/13033 | A1 | 4/1997 |
| WO | WO 97/39189 | A1 | 10/1997 |

(Continued)

OTHER PUBLICATIONS

Korean Patent Office, International Search Report in International Patent Application No. PCT/US2014/055415, dated Dec. 26, 2014, 4 pp.

(Continued)

*Primary Examiner* — Mark Halpern
(74) *Attorney, Agent, or Firm* — Leydig, Voit & Mayer, Ltd.

(57) ABSTRACT

A paper-making aid composition comprising dialdehyde-modified polyacrylamide-type strengthening agent, polyacrylamide-type strengthening agent and water and having a pH value of 6 or more is provided. A method of paper-making by using the paper-making aid composition is also provided.

20 Claims, No Drawings

(56) References Cited

FOREIGN PATENT DOCUMENTS

| | | | |
|---|---|---|---|
| WO | WO 98/06898 | A1 | 2/1998 |
| WO | WO 98/45536 | A1 | 10/1998 |
| WO | WO 99/05361 | A1 | 2/1999 |
| WO | WO 00/11046 | A1 | 3/2000 |
| WO | WO 03/052206 | A1 | 6/2003 |
| WO | WO 2004/061235 | A1 | 7/2004 |
| WO | WO 2006/056381 | A1 | 6/2006 |
| WO | WO 2007/104716 | A1 | 9/2007 |
| WO | WO 2009/059725 | A2 | 5/2009 |
| WO | WO 2009/059725 | A3 | 5/2009 |
| WO | WO 2009/138457 | A1 | 11/2009 |
| WO | WO 2010/020551 | A1 | 2/2010 |
| WO | WO 2010/059946 | A1 | 5/2010 |
| WO | WO 2010/089334 | A1 | 8/2010 |
| WO | WO 2010/145956 | A1 | 12/2010 |
| WO | WO 2011/048000 | A1 | 4/2011 |
| WO | WO 2011/090672 | A1 | 7/2011 |

OTHER PUBLICATIONS

Korean Patent Office, Written Opinion in International Patent Application No. PCT/US2014/055415, dated Dec. 24, 2014, 9 pp.
European Patent Office, Extended European Search Report in European Patent Application No. 14843685.0, dated Mar. 17, 2017, 6 pp.
U.S. Appl. No. 15/021,479, filed Mar. 11, 2016.

PAPER-MAKING AID COMPOSITION AND PROCESS FOR INCREASING ASH RETENTION OF FINISHED PAPER

CROSS-REFERENCE TO RELATED APPLICATIONS

This application is a 371 of PCT/US2014/055415 filed 12 Sep. 2014, which claims priority to Chinese Patent Application No. 201310413579.X, filed Sep. 12, 2013, both of which are incorporated by reference herein in their entireties for all purposes.

TECHNICAL FIELD OF THE INVENTION

Embodiments of the present invention relates to a field of paper-making process, especially to a process for increasing ash retention of finished paper and a related paper-making aid composition.

BACKGROUND OF THE INVENTION

Chemical aids for paper-making play an important role in the sustainable development of the paper-making industry, and therefore attract extensive attention. Chemical aids for paper-making can be classified into processing aids and functional aids. Strength aid is one of the functional aids. The strength parameters of paper comprise dry strength, wet strength and temporary wet strength, etc.

At present, frequently-used dry strength aids includes, for example, natural polymers such as cationic starch, CMC and guar gum, and synthetic polymers such as polyacrylamide (cationic, anionic and amphoteric), glyoxylated polyacrylamides (GPAMs), polyvinylamine, etc. Among the dry strength aids for paper, polyacrylamides (PAMs) are most widely used today. Categorized from their ionicity, the PAM type of paper dry strength aid is classified into anionic, cationic and amphoteric types. Since the early 1980's, amphoteric polyacrylamide polymers were developed by copolymerization of anionic vinyl monomers and cationic vinyl monomers, as well as acrylamide monomers (see JP1049839B). Di-aldehyde functionalized polyacrylamide, prepared from di-aldehyde and polyacrylamide, was developed first as a temporary wet strength resin (see U.S. Pat. No. 3,556,932A, U.S. Pat. No. 4,605,702A) back in the 1970's and 1980's. It was then developed as a dry strength resin used in combination with another wet strength resin, usually a polyamine-epichlorohydrin or polyamide-epichlorohydrin type of wet strength resin, as described in U.S. Pat. No. 5,674,362A. Glyoxalated polyacrylamide (GPAM), prepared from glyoxal and backbone polyacrylamide, is the most widely made paper dry strength aid in this category. Being used independently, anionic and amphoteric (WO0011046A1), as well as cationic (U.S. Pat. No. 7,641,766B2, U.S. Pat. No. 7,901,543B2) di-aldehyde functionalized polyacrylamide, mostly GPAMs, were developed to impart paper with enhanced dry strength, wet strength or drainage ability.

Dialdehyde-modified cationic, anionic and amphoteric acrylamide-containing polymer, particularly the glyoxylated DADMAC/acrylamide copolymers (GPAMs), is used as a dry strength and temporary wet strength aid in producing paper and paperboard. Such polymer strength aid is of great interest for paper and paperboard manufacturer since (1) it provides good temporary wet strength together with good dry strength, and (2) it also helps improve the paper machine runnability. Amphoteric acrylamide-containing polymer can provide the paper with good dry strength. Meanwhile, this type of strength aid possesses high content of active ingredients without any issue of shelf life. At present, both glyoxylated acrylamide copolymers and amphoteric polyacrylamides are widely-used strength aids. Further research and development on these two strength aids are rather intensive. Besides, the research on the combination use or the mixture of these two strength aids are carried out for the purpose of combining their respective advantages.

WO9806898A1 discloses a paper-making process, wherein cationic polymer selected from the group consisting of cationic starch and cationic wet strength resin, and amphoteric polyacrylamide-type polymer is added to the aqueous pulp slurry in order to increase the dry strength of paper, and wherein GPAM can be used as the cationic wet strength resin. Moreover, U.S. Pat. No. 6,294,645B1 discloses a dry-strength system for paper comprising PAE, amphoteric PAM and wet strength resin, wherein GPAM can be used as the cationic wet strength resin. JP2004011059A discloses a combination use of anionic polyacrylamide containing specific anionic monomer(s) and amphoteric polyacrylamide to strengthen the dry strength and drainage properties of finished paper. It is mentioned in the examples of this patent document that the aqueous solution of the anionic polyacrylamide was first adjusted to a pH value of 5.1-5.3, and then a 1% dilution of this aqueous solution of the anionic polyacrylamide was mixed with a 1% dilution of the aqueous solution of the amphoteric polyacrylamide prior to the addition into the slurry. JP2006138029A discloses a combination use of the anionic polyacrylamide and the amphoteric polyacrylamide to enhance the dry strength and drainage properties of finished paper. In the patent document, the following method is used: adjusting in advance the aqueous solution of the anionic polyacrylamide to a pH value of 6 or more, and then mixing a dilution of the aqueous solution of the anionic polyacrylamide and a dilution of the aqueous solution of the amphoteric polyacrylamide prior to the addition into the slurry. However, the above documents simply adjust the pH value of only the aqueous solution of the anionic polyacrylamide. Moreover, neither of the above documents discloses nor suggests adjusting the pH value of the mixed solution, not to mention the influence of adjusting the pH values of the mixed solution on the ash retention of the finished paper.

In recent years, ash retention of finished paper becomes one of the important parameters to evaluate the properties of finished paper as the massive utilization of the recycled paper pulp. Whether the ash retention of finished paper can be effectively improved while maintaining the strength effects for finished paper becomes one of the criterions to evaluate the comprehensive performance of the strength aids.

However, the existing strengthening agents, method of using those strengthening agent, and the related paper-making line are relatively stable. From the economical viewpoint, it is desired to, starting from the existing strengthening agents, modify its composition and the use method thereof to a minimal extent, and the strengthening agents would have a better effect of increasing the ash retention for finished paper.

SUMMARY OF THE INVENTION

In order to resolve the above mentioned issues, the inventors have performed intensive and deep research, surprisingly found that: when a aqueous liquid containing dialdehyde-modified polyacrylamide-type strengthening agent(s) and polyacrylamide-type strengthening agent(s) as strengthening agent (enhancer) for paper-making, it is only necessary to adjust the aqueous liquid to have a pH value of 6.0 or more, and the ash retention in the finished paper can be substantially improved. The invention has been completed based on the above findings.

The invention first provides a paper-making aid composition comprising one or more dialdehyde-modified polyacrylamide-type strengthening agent(s), one or more polyacrylamide-type strengthening agent(s) and water as medium;

the dialdehyde-modified polyacrylamide-type strengthening agent is selected from a group consisting of cationic dialdehyde-modified polyacrylamide-type strengthening agents, anionic dialdehyde-modified polyacrylamide-type strengthening agents and amphoteric dialdehyde-modified polyacrylamide-type strengthening agents;

the polyacrylamide-type strengthening agent is selected from a group consisting of cationic polyacrylamide-type strengthening agents, anionic polyacrylamide-type strengthening agents and amphoteric polyacrylamide-type strengthening agents; but the following cases are excluded:

(A) all of the dialdehyde-modified polyacrylamide-type strengthening agents are cationic dialdehyde-modified polyacrylamide-type strengthening agent, and all of the polyacrylamide-type strengthening agents are cationic polyacrylamide-type strengthening agent, and (B) all of the dialdehyde-modified polyacrylamide-type strengthening agents are anionic dialdehyde-modified polyacrylamide-type strengthening agent, and all of the polyacrylamide-type strengthening agents are anionic polyacrylamide-type strengthening agents;

wherein the paper-making aid composition has a pH value of 6.0 or above.

The invention further provides a method for increasing ash retention of finished paper, which comprises adding the above paper-making aid composition as paper-making aid into a plup slurry in a paper-making process.

The invention further provides a method for paper-making, comprising the steps of:

(a) providing a pulp slurry; simultaneously or before or after (b) providing the above paper-making aid composition;

(c) adding the paper-making aid composition into the paper slurry to obtain a paper stock;

(d) forming the paper stock obtained in the step (c) to obtain a wet paper web;

(e) pressing and draining the wet paper web obtained in the step (d) to obtain a wet paper sheet; and (f) drying the wet paper sheet obtained in the step (e) to obtain a paper sheet.

By adopting the paper-making aid composition according the invention in the paper-making process, the ash retention in the finished paper can be substantially increased as compared to the paper-making aid composition which is not adjusted to a pH value of 6.0 or more.

DETAILED DESCRIPTION OF THE INVENTION

In order to make the object, technical solutions and advantages of the embodiments of the invention more clear, the technical solutions of the embodiments of the present invention are clearly and completely described below in the embodiments of the present invention. The embodiments described are merely some, rather than all embodiments of the present invention.

Paper-Making Aid Composition

The invention first provides a paper-making aid composition comprising one or more dialdehyde-modified polyacrylamide-type strengthening agent(s), one or more polyacrylamide-type strengthening agent(s) and water as medium, and having a pH value of 6.0 or above; wherein the dialdehyde-modified polyacrylamide-type strengthening agent is selected from a group consisting of cationic dialdehyde-modified polyacrylamide-type strengthening agents, anionic dialdehyde-modified polyacrylamide-type strengthening agents and amphoteric dialdehyde-modified polyacrylamide-type strengthening agents;

the polyacrylamide-type strengthening agent is selected from a group consisting of cationic polyacrylamide-type strengthening agents, anionic polyacrylamide-type strengthening agents and amphoteric polyacrylamide-type strengthening agents;

but the following cases are excluded:

(A) all of the dialdehyde-modified polyacrylamide-type strengthening agents are cationic dialdehyde-modified polyacrylamide-type strengthening agent, and all of the polyacrylamide-type strengthening agents are cationic polyacrylamide-type strengthening agent, and (B) all of the dialdehyde-modified polyacrylamide-type strengthening agents are anionic dialdehyde-modified polyacrylamide-type strengthening agent, and all of the polyacrylamide-type strengthening agents are anionic polyacrylamide-type strengthening agents.

1. Dialdehyde-Modified Polyacrylamide-Type Strengthening Agents

In the context, the dialdehyde-modified polyacrylamide-type strengthening agent is a common functional aids for paper-making, which is prepared by modifying a base polymer of polyacrylamide type with a dialdehyde. The dialdehyde modified polyacrylamide-type strengthening agents are usually used as dry strength enhancer while some of them can be used to endow the paper with wet strength and drainage properties.

The polyacrylamide-type base polymer can be cationic or anionic or amphoteric. Correspondingly, the dialdehyde-modified polyacrylamide-type strengthening agent is cationic or anionic or amphoteric. The cationic polyacrylamide-type base polymer is a copolymer of one or more acrylamide monomer(s) and one or more cationic monomer(s) (see, e.g., U.S. Pat. No. 7,641,766B2, U.S. Pat. No. 7,901,543B2). The anionic polyacrylamide-type base polymer is a copolymer of one or more acrylamide monomer(s) and one or more anionic monomer(s) (see, e.g., WO0011046A1). The amphoteric, polyacrylamide-type base polymer is a copolymer of one or more acrylamide monomer(s), one or more cationic monomer(s) and one or more anionic monomer(s) (see, e.g., WO0011046A1).

"Acrylamide monomer" means the monomer of formula

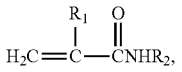

wherein $R_1$ is H or $C_1$-$C_4$ alkyl and $R_2$ is H, $C_1$-$C_4$ alkyl, aryl or arylalkyl. Acrylamide monomers can comprise acrylamide or methacrylamide, for example can be acrylamide.

"Alkyl" means a monovalent group derived from a straight or branched chain saturated hydrocarbon by the removal of a single hydrogen atom. Representative alkyl groups include methyl, ethyl, n- and iso-propyl, cetyl, and the like.

"Alkylene" means a divalent group derived from a straight or branched chain saturated hydrocarbon by the removal of two hydrogen atoms. Representative alkylene groups include methylene, ethylene, propylene, and the like.

"Aryl" means an aromatic monocyclic or multicyclic ring system of about 6 to about 10 carbon atoms. The aryl is optionally substituted with one or more $C_1$-$C_{20}$ alkyl, alkoxy or haloalkyl groups. Representative aryl groups include phenyl or naphthyl, or substituted phenyl or substituted naphthyl.

"Arylalkyl" means an aryl-alkylene-group where aryl and alkylene are defined herein. Representative arylalkyl groups include benzyl, phenylethyl, phenylpropyl, 1-naphthylmethyl, and the like, e.g., benzyl.

There is not special limitation to the di-aldehyde. The di-aldehyde is selected from glyoxal, malonaldehyde, succinic aldehyde and glutaraldehyde. For example, the di-aldehyde can be glyoxal.

There is not special limitation to the cationic monomer. The cationic monomer can be one or two or more selected from a group consisting of diallyldimethylammonium chloride, N-(3-dimethylaminopropyl)methacrylamide, N-(3-dimethylaminopropyl)acrylamide, trimethyl-2-methacroyloxyethylammonium chloride, trimethyl-2-acroyloxyethylammonium chloride, methylacryloxyethyldimethyl benzyl ammounium chloride, acryloxyethyldimethyl benzyl ammounium chloride, (3-acrylamidopropyl)trimethylammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, and 2-(dimethylamino)ethyl acrylate. For example, the cationic monomer can be diallyldimethylammonium chloride.

There is no special limitation to the anionic monomer. The anionic monomer can be one or two or more selected from a group consisting of acrylic acid, methacrylic acid, itaconic acid, maleic acid, and maleic anhydride. For example, the anionic monomer can be acrylic acid, itaconic acid, a salt of acrylic acid, and/or a salt of itaconic acid.

In the context, there is no special limitation to the sum of the cationic monomers and/or the anionic monomers, as long as a stable polymer is prepared. For example, the sum of the cationic monomers and/or the anionic monomers can be 0.1-50 mol %, such as 5-30 mol %, of the copolymer, depending on the practical application, but without being limited to those.

In the context, there is no special limitation to the ratio of the cationic monomers to the anionic monomers in the dialdehyde modified polyacrylamide-type strengthening agent. For example, the molar ratio of the cationic monomers to the anionic monomers can be 1:100-100:1, e.g., 1:10-10:1, but without being limited to those.

In the context, there is no special limitation to the glycol/acrylamide ratio (G/A ratio) in the dialdehyde modified polyacrylamide-type strengthening agent. The G/A ratio can be 0.01:1-1:1 (molar ratio), e.g., 0.1:1-0.8:1 (molar ratio), but without being limited to those).

There is no special limitation to the weight average molecular weight of the dialdehyde modified polyacrylamide-type strengthening agent, as long as it can be used as a strength enhancer (in particular, a dry strength enhancer). The weight average molecular weight of the dialdehyde modified polyacrylamide-type strengthening agent can be 100,000-10,000,000 Dalton, or 500,000-2,000,000 Dalton, or 800,000-1,500,000 Dalton, or 1,000,000-1,200,000 Dalton.

The dialdehyde modified polyacrylamide-type strengthening agent can be a cationic copolymer of a copolymer of glycolated cationic polyacrylamide and diallyldimethylammonium chloride, also called as GPAM/DADMAC copolymer. The GPAM/DADMAC copolymer can have a glycol/acrylamide ratio (G/A ratio) of 0.01:1-1:1 (molar ratio), e.g., 0.1:1-0.8:1 (molar ratio). Relative to 100 molar parts of total acrylamide and diallyldimethylammonium chloride constituting the GPAM/DADMAC copolymer, the acrylamide can be 75-99 molar parts, e.g., 85-95 molar parts, but without being limited to those. For example, the GPAM/DADMAC copolymer can have a weight average molecular weight of 100,000-10,000,000 Dalton, e.g., 500,000-2,000,000 Dalton, e.g., 800,000-1,500,000 Dalton, e.g., 1,000,000-1,200,000 Dalton, but without being limited to those.

The dialdehyde-modified polyacrylamide-type strengthening agent can be prepared according to the known technology, for example, referring to U.S. Pat. No. 7,641,766 B2 assigned to Nalco Co. It should be noted that, in the process of producing the dialdehyde-modified polyacrylamide-type strengthening agent, a cross-linking agent and/or a chain transfer agent can be used to provide a branched/cross-linked structure of the copolymer. As the commercially available dialdehyde-modified polyacrylamide-type strengthening agent, Nalco 64280, Nalco 64170, and Nalco 64180 can be named.

2. Polyacrylamide-Type Strengthening Agents

In the context, the polyacrylamide-type strengthening agents refer to common functional aids for paper-making.

The polyacrylamide-type strengthening agents can be cationic or anionic or amphoteric. The cationic polyacrylamide strengthening agent is a copolymer of one or more acrylamide monomer(s) and one or more cationic monomer (s). The anionic polyacrylamide strengthening agent is a copolymer of one or more acrylamide monomer(s) and one or more anionic monomer(s). The amphoteric polyacrylamide strengthening agent is a copolymer of one or more acrylamide monomer(s), one or more cationic monomer(s), and one or more anionic monomer(s) (see, e.g., JP1049839B, U.S. Pat. No. 4,251,651A). The polyacrylamide strengthening agent can be used as dry strength enhancer.

The definition and the exemplary scope of "acrylamide monomer" refer to the description in the above Part "1. Dialdehyde-modified polyacrylamide-type strengthening agents".

In the context, the weight average molecular weight of the polyacrylamide-type strengthening agent is critical, and can be 100,000-10,000,000 Dalton, e.g., 500,000-2,000,000 Dalton, or 900,000-1,200,000 Dalton.

In the context, the cationic monomer can be one or two or more selected from a group consisting of diallyldimethylammonium chloride, N-(3-dimethylaminopropyl)methacrylamide, N-(3-dimethylaminopropyl)acrylamide, trimethyl-2-methacroyloxyethylammonium chloride, trimethyl-2-acroyloxyethylammonium chloride, methylacryloxyethyldimethyl benzyl ammounium chloride, acryloxyethyldimethyl benzyl ammounium chloride, (3-acrylamidopropyl)trimethylammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, and 2-(dimethylamino)ethyl acrylate. For example, the cationic monomer can be one or two or more selected from a group consisting of diallyldimethylammonium chloride, N-(3-dimethylaminopropyl)acrylamide, trimethyl-2-acroyloxyethylammonium chloride or 2-(dimethylamino)ethyl methacrylate, but without being limited to those. The anionic monomer can be one or two or more selected from a group consisting of acrylic acid, methacrylic acid, itaconic acid, maleic acid, and maleic anhydride. For example, the anionic monomer can one or two or more selected from the group consisting of acrylic acid or itaconic acid, a salt of acrylic acid and a salt of itaconic acid, but without being limited to those. There is no special limitation to the sum of the cationic monomers and/or the anionic monomers, as long as a stable polymer is prepared. For example, depending on the practical application, the sum of the cationic monomers and/or the anionic monomers can be 0.1-50 mol %, such as 1-20 mol %, of the copolymer, but is not limited to those. Moreover, there is no special limitation to the molar ratio of the cationic monomers to the anionic monomers in the amphoteric polyacrylamide. For example, the molar ratio of the cationic monomers to the anionic monomers can be 1:100-100:1, e.g., 5:1-2:1, but is not limited to those.

The amphoteric polyacrylamide-type strengthening agent can be prepared according to the known technology, e.g., as described in JP54030913A, JP58004898A. It should be noted that, in the process of producing the polyacrylamide-type strengthening agent, a cross-linking agent and/or a chain transfer agent can be used to provide a branched/cross-linked structure of the copolymer. As commercially available amphoteric polyacrylamide-type strengthening agents, Nalco 847 and Nalco 828 from Nalco Company, etc., can be named.

3. Water as Medium

There is no special limitation to the water as medium, as long as it satisfies the requirements of a medium used for paper-making aids. Tap water, distilled water, deionized water, ultrapure water can be used.

4. Solid Contents of Two Strengthening Agent and Ratio Thereof

There is no special limitation to the solid contents of the dialdehyde-modified polyacrylamide-type strengthening agent and the polyacrylamide-type strengthening agent, which can be suitably selected by one skilled in the art according to the store stability, the operability, etc.

There is no special limitation to the dialdehyde-modified polyacrylamide-type strengthening agent in the paper-making aid composition. Considering the ease of the production and the operation, the solid content can be 0.01-50 wt %, e.g., 0.1-40 wt %, e.g., 1-30 wt %, e.g., 5-25 wt %. There is no special limitation to the polyacrylamide-type strengthening agent in the paper-making aid composition, which can be 0.01-50 wt %, e.g., 0.1-40 wt %, e.g., 1-30 wt %, e.g., 5-25 wt %. There is not special limitation to the total solid content of the dialdehyde-modified polyacrylamide-type strengthening agent and the polyacrylamide-type strengthening agent in the paper-making aid composition. Considering the easiness of the production and the operation, the solid content can be 0.01-60 wt %, e.g., 0.1-40 wt %, e.g., 1-30 wt %, e.g., 5-25 wt %.

There is no special limitation to the ratio between the solid contents of the dialdehyde-modified polyacrylamide-type strengthening agent and the polyacrylamide-type strengthening agent in the paper-making aid composition, which can be suitably selected by one skilled in the art according to the strength properties of the desired paper. In order to effectively increase ash retention in the finished paper and/or paper strength, the dialdehyde-modified polyacrylamide-type strengthening agent and the amphoteric the polyacrylamide-type strengthening agent can have a ratio of solid contents of such as 1:99-99:1, e.g., 10:90-90:10, e.g., 30:70-70:30, e.g., 40:60-60:40, e.g., 50:50.

5. Other Components

Optionally, the paper-making aid composition according to the invention may contain or may not contain other chemical aids for paper-making, especially synthetic polymer aids for paper-making, e.g., polyvinyl alcohol (PVA), urea-formaldehyde resin, melamine formaldehyde resin, polyethyleneimine (PEI), polyethylene oxide (PEO), polyamide-epichlorohydrin resin (PAE), etc. Especially, as required, the paper-making aid composition according to the invention may contain or may not contain other dry strength enhancers. Especially, as required, the paper-making aid composition according to the invention may contain or may not contain other dry strength enhancers. In the case that the paper-making aid composition contains other chemical aids for paper-making, those skilled in the art can select the suitable kinds and amounts of the chemical aids for paper-making as required. Moreover, in an embodiment, the paper-making aid composition may contain exclusively the dialdehyde-modified polyacrylamide-type strengthening agent, the polyacrylamide-type strengthening agent and water as medium.

6. PH Value of the Paper-Making Aid Composition

The paper-making aid composition must has a pH value of 6.0 or above, e.g., 6.5-13.0, e.g., 7.0-12.0, e.g., 7.5-11.0, e.g., 8.0-10.0, wherein the pH value is measured at room temperature (approximately 25° C.). The pH value can be measured by conventional methods, such as using pH test papers, pH meter, etc. If the pH value of the aqueous liquid comprising the dialdehyde-modified polyacrylamide-type strengthening agent and the polyacrylamide-type strengthening agent is below 6.0 prior to the adjustment, it is required to adjust the pH value to be 6.0 or above, e.g., 8.0-10.0. In this situation, the adjustment of pH value can be performed, for example, by adding an base into the aqueous liquid comprising the dialdehyde-modified polyacrylamide-type strengthening agent and the polyacrylamide-type strengthening agent, wherein the base can be the examples for base in the following section "8. Paper-making Aid Composition". If the pH value of the aqueous liquid comprising the dialdehyde-modified polyacrylamide-type strengthening agent and the polyacrylamide-type strengthening agent is 6.0 or above prior to an adjustment, the adjustment of its pH value can be carried out in a way that no operation of adjusting the pH value is performed, or can be any operation of adjusting the pH value to any other ranges within the pH 6.0 or above, such as 6.5-13.0, 7.0-12.0, 7.5-11.0, 8.0-10.0. It should be noted that, increasing the pH value can be performed by adding the above-mentioned base; decreasing the pH value can be performed by adding an acid. In the case that decreasing the pH value is desired, the acid that can be used is as described in the following section "8. Process for the preparation of paper-making aid composition".

7. Ionicity of Polymer

At least one part of the dialdehyde-modified polyacrylamide-type strengthening agent carries charges opposite to another part of the polyacrylamide-type strengthening agent. That is, the following two cases are excluded:

(A) all of the dialdehyde-modified polyacrylamide-type strengthening agents are cationic dialdehyde-modified polyacrylamide-type strengthening agent, and all of the polyacrylamide-type strengthening agents are cationic polyacrylamide-type strengthening agent; and (B) all of the dialdehyde-modified polyacrylamide-type strengthening agents are anionic dialdehyde-modified polyacrylamide-type strengthening agent, and all of the polyacrylamide-type strengthening agents are anionic polyacrylamide-type strengthening agents. That is, the allowable cases are, for example, (1) at least part or all of the dialdehyde-modified polyacrylamide-type strengthening agent is cationic, and at least part or all of the polyacrylamide-type strengthening agent is anionic or amphoteric; (2) at least part or all of the dialdehyde-modified polyacrylamide-type strengthening agent is anionic, and at least part or all of the polyacrylamide-type strengthening agent is cationic or amphoteric; (3) at least part or all of the dialdehyde-modified polyacrylamide-type strengthening agent is amphoteric, and at least part or all of the polyacrylamide-type strengthening agent is cationic, anionic or amphoteric.

8. Process for the Preparation of Paper-Making Aid Composition

There is no special limitation to the paper-making aid composition, which can be suitably selected by one skilled in the art, as long as the paper-making aid composition can be obtained.

For example, without any limitation, the paper-making aid composition can be prepared by adopting the following method comprising:

(a) providing the first aqueous liquid and the second aqueous liquid, wherein the first aqueous liquid contains the dialdehyde-modified polyacrylamide-type strengthening agent and water as medium and the second aqueous liquid contains the polyacrylamide-type strengthening agent and water as medium;

(b) mixing the first aqueous liquid and the second aqueous liquid to obtain a mixed aqueous liquid; and (c) adjusting the pH value of the mixed aqueous liquid to 6.0 or above, e.g., a pH value of 6.5-13.0, e.g., a pH value of 7.0-12.0, e.g., a pH value of 7.5-11.0, e.g., a pH value of 8.0-10.0.

Herein, there is no special limitation to the solid content of the dialdehyde-modified polyacrylamide-type strengthening agent in the first liquid, which can be 0.01-60 wt %, e.g., 1-20 wt %, e.g., 5-15 wt %, considering the facility of the preparation and the operation. There is no special limitation to the solid content of the polyacrylamide-type strengthening agent in the second liquid, which can be 0.01-60 wt %, e.g., 5-25 wt %, e.g., 10-20 wt %, considering the facility of the preparation and the operation. As required, the skilled in the art can select the solid content of the dialdehyde-modified polyacrylamide-type strengthening agent in the first liquid, the solid content of the polyacrylamide-type strengthening agent in the second liquid, and the ratio between the first liquid and the second liquid, so that the paper-making aid composition can be prepared.

The first liquid may contain or may not contain the polyacrylamide-type strengthening agent, the second liquid may contain or may not contain the dialdehyde-modified polyacrylamide-type strengthening agent, as long as the amount of the dialdehyde-modified polyacrylamide-type strengthening agent and the polyacrylamide-type strengthening agent in the mixed aqueous liquid obtained by mixing the both is with in the scope of the invention. Considering the facility of obtaining, for example, the first liquid does not contain the polyacrylamide-type strengthening agent, and the second liquid does not contain the dialdehyde-modified polyacrylamide-type strengthening agent.

Optionally, the first liquid and the second liquid may contain or may not contain other chemical aids for paper-making, especially synthetic polymer aids for paper-making, e.g., polyvinyl alcohol (PVA), urea-formaldehyde resin, melamine formaldehyde resin, polyethyleneimine (PEI), polyethylene oxide (PEO), polyamide-epichlorohydrin resin (PAE), etc. Especially, as required, the first liquid and the second liquid may contain or may not contain other dry strength enhancers. In the case that the first liquid and the second liquid contains other chemical aids for paper-making, those skilled in the art can select the suitable kinds and amounts of the chemical aids for paper-making as required.

There is no special limitation to the way of mixing the first aqueous liquid and the second aqueous liquid to obtain a mixed aqueous liquid, as long as the first liquid and the second liquid can be mixed sufficiently. The first liquid can be added into the second liquid, or the second liquid can be added into the first liquid, or the first liquid and the second liquid can be added together into a container provided otherwise. Moreover, as required, the mixing can be promoted by other operations such as stirring, oscillating.

There is no special limitation to the way of adjusting the pH value of the mixed aqueous liquid to 6.0 or above, which can be performed according to a conventional method in the art.

For example, under the circumstances that the mixed aqueous liquid is not subject to adjustment of the pH value and has a pH value of below 6.0, the adjustment of pH value can be performed by adding base into the mixed aqueous liquid. There is no special limitation to the kinds of the used base, and it can be inorganic base such as sodium hydroxide, potassium hydroxide, ammonia, as well as organic base such as triethylamine, and it can also be a salt formed by a strong base and a weak acid, such as sodium hydrogen carbonate, potassium carbonate, or can be a basic salt such as basic calcium carbonate. There is no special limitation to the form of the used base, and it can be in the form of solid, gas or liquid (caustic liquor). In order to reduce the required amount for adjusting the pH value, diminish the influence on other properties of the mixed aqueous liquid and facilitate the operation, for example, strongly caustic liquor can be used. The strong base for strongly caustic liquor comprises, for example, potassium hydroxide, sodium hydroxide, lithium hydroxide, basium hydroxide, calcium hydroxide, etc. The strong base in the strongly caustic liquor can be in a concentration of, e.g., 1 wt % or above, e.g., 5 wt % or above. The addition of the caustic liquor into the mixed aqueous liquid can be, for sample, dropwise addition. During dropwise addition, operations such as stirring, oscillating can be carried out to promote the mixing.

For example, the pH value can be measured before, during or after the addition of the base into the mixed aqueous liquid. The addition of the base can be adjusted according to the measured pH value, so that the pH value of the mixed aqueous liquid is within the above-mentioned specified range or exemplary ranges. The pH value can be measured by conventional methods, such as by using pH test paper, pH meter, etc., wherein the pH value can be measured at room temperature (approximately 25° C.).

As an embodiment, in the case that the pH value of the mixed aqueous liquid obtained by mixing the first liquid and the second liquid has been within the above specified range, adjusting the pH value of the mixed aqueous liquid can be carried out in a way that no operation of adjusting the pH value is performed, or can be any operation of adjusting the pH value to any other ranges within the pH 6.0 or above, such as 6.5-13.0, 7.0-12.0, 7.5-11.0. Moreover, it should be noted that, increasing the pH value can be performed by adding the above-mentioned base; decreasing the pH value can be performed by adding an acid. There is no special limitation to the kind of the used acid, which can be inorganic acid such as sulfuric acid, hydrochloric acid, nitric acid, phosphoric acid, and carbonic acid, as well as organic acid such as methanesulfonic acid, citric acid, tartaric acid, oxalic acid, and malic acid, and which can also be a salt formed by a strong acid and a weak base, such as ammonium nitrate, aluminum sulfate, or an acidic salt such as sodium bisulfate. There is no special limitation to the form of the used acid, and it can be in the form of solid, gas or liquid (acidic liquor). In order to reduce the required amount for adjusting the pH value, diminish the influence on other properties of the mixed aqueous liquid and facilitate the operation, for example, strongly acidic liquor can be used. The strong acid in the acidic liquor comprise, for example, sulfuric acid, hydrochloric acid, nitric acid, methanesulfonic acid. The strong acid in the strongly acidic liquor can be in a concentration of, for example, 1 wt % or above, e.g., 5 wt % or above. The addition of the acidic liquor into the mixed aqueous liquid can be, for sample, dropwise addition. During dropwise addition, operations such as stirring, oscillating can be carried out to promote the mixing.

It should be noted that, the first liquid and the second liquid can be subject to an adjustment of pH value prior to the mixing. For example, the pH value of at least one of the first liquid and the second liquid is adjusted prior to the mixing, so that the pH value after the mixing achieve a pH value of 6.0 or above, e.g., 6.5-13.0, 7.0-12.0, 7.5-11.0, 8.0-10.0. As an embodiment, the pH values of the first liquid and the second liquid can be separately adjusted to a pH value of 6.0 or above before the mixing, so that the pH value after mixing the both can be a pH value of 6.0 or above, e.g., 6.5-13.0, 7.0-12.0, 7.5-11.0, 8.0-10.0. Herein, the method of adjusting the pH value of the first liquid and the second liquid refer to the above method of adjusting the pH value of the mixed aqueous liquid.

It should be noted that, in order to facilitate the operation, the first liquid, the second liquid and the mixed liquid can be separately diluted in an appropriate factor, for example, 2-100 times, e.g., 5-20 time, but without being limited to this.

It should be also noted that, the paper-making aid composition, the first liquid, the second liquid and the mixed aqueous liquid can be in a form of solution, or in a form of dispersion. Moreover, the paper-making aid composition can be used in, for example, increasing the ash retention of the finished paper and/or increasing the strength of finished paper.

Method for Increasing Ash Retention of the Finished Paper and/or Increasing Strength of Paper The invention further provides a method for increasing ash retention of the finished paper and/or increasing strength of paper comprising adding the above mentioned paper-making aid composition as paper-making aid into a plup slurry in a paper-making process.

The raw fiber material for paper-making or the paper pulp component itself can contain an amount of mineral matter. During the paper-making process, certain amount of mineral matter can be added in order to save the cost of the raw fiber material. Therefore, after the paper is burned at a high temperature and calcinated, the remaining mineral matter is called as ash. Ash retention refers to: after the paper, paperboard and pulp is burned at a specified temperature, the ratio by mass of the remaining matter to the original oven-dry specimen The ash retention can be calculated by the following formula:

$$X=(m2-m1)/m\times 100\%$$

m1—mass of crucible after burning, g m2—mass of crucible containing ash after burning, g m—over-dry mass of specimen, g X—ash retention, % wherein the determination method for the ash content of paper and paperboard can refer to GB/T 463-1989. For example, a certain amount of paper sample is accurately weighed and placed into a crucible which has been pre-burned to a constant, and then transferred into a muffle furnace to undergo burning at 550° C. for 1.5 hour. The crucible is taken out and cooled in the air for 5-10 minutes and then transferred to a dryer, cooled and weighed until a constant weight.

The dosage of the paper-making aid composition in the pulp can be determined by those skilled in the art according to the practical requirements. For example, the dosage can be 0.01 kg/ton dry fiber and 50 kg/ton dry fiber, e.g., 0.1 kg/ton dry fiber and 10 kg/ton dry fiber, based on the weight ratio of the sum of the dialdehyde-modified polyacrylamide-type strengthening agent(s) and the polyacrylamide-type strengthening agent(s) relative to the dry fiber in the pulp slurry.

In the context, "pulp slurry" or "pulp" is intended to mean a product obtained from a pulping process. "Pulping" involves a production process of dissociating the plant fiber raw materials by a chemical method or a mechanical method, or a combination of both, to form a paper pulp with an inherent color (unbleached pulp) or further to form a bleached pulp.

The pulp can be any known pulp, including but not limited to, mechanical pulp, chemical pulp, chemical mechanical pulp, and recycled waste paper pulp, for example, a pulp containing mechanical pulp and/or recycled fiber.

Paper-Making Process

Moreover, the invention provides a method for paper-making, comprising the steps of:

(a) providing a pulp slurry; simultaneously or before or after (b) providing the paper-making aid composition;

(c) adding the paper-making aid composition into the paper slurry to obtain a paper stock;

(d) forming the paper stock obtained in the step (c) to obtain a wet paper web;

(e) pressing and draining the wet paper web obtained in the step (d) to obtain a wet paper sheet; and (f) drying the wet paper sheet obtained in the step (e) to obtain a paper sheet.

In the context, "paper-making process" or "process for paper-making" means a method of making paper products from pulp comprising forming an aqueous cellulosic paper-making furnish, draining the furnish to form a sheet and drying the sheet.

In the context, "pulp slurry" or "pulp" is intended to mean a product obtained from a pulping process. "Pulping" involves a production process of dissociating the plant fiber raw materials by a chemical method or a mechanical method, or a combination of the both, to form a paper pulp with an inherent color (unbleached pulp) or further to form a bleached pulp. The pulp can be any known pulp, including but not limited to, mechanical pulp, chemical pulp, chemical mechanical pulp, and recycled waste paper pulp, for example, a pulp containing mechanical pulp and/or recycled fiber.

In the context, the pulp is subject to the pulping and additive adjustment, producing a fiber suspension which can be used in hand sheet. Such fiber suspension is called as "paper stock," so as to be distinguished from the paper slurry which is not subject to a pulping and an additive adjustment.

In the context, "wet paper sheet" refers to a product obtained after the pulp stock passed the headbox, the forming section and the press section to be formed and partially drained, wherein the dryness of the wet paper sheet can be in a range of from 35% to 50%. For the sake of clarity, the product which comes from the forming section but is not subject to drainage in the press section is called as "wet paper web", which can have a dryness in a range of from 15% to 25%.

In the context, "paper sheet" refers to a product obtained after the wet paper sheet is dried in the dryer section. The dryness of the paper sheet can be in a range of from 92% to 97%.

The paper-making process according to the invention can be carried out by the following procedure, but not limited to this, i.e., the paper-making process according to the invention can be also carried out by other known paper-making procedures in the art.

The treatment before the paper stock flowing onto the wire comprises:

(1) the preparation of paper stock: the paper slurry can be made into a paper stock, and the preparation of the paper stock comprises pulping and additive adjustment (adding additives such as sizings, fillers, pigments and aids). The paper slurry is first subject to pulping wherein the fiber of the paper slurry undergoes treatments such as necessary cutting, swelling and fine fibrosis, so as to render the paper having physical properties and mechanical properties required by a certain sort of paper and meeting the requirements of a paper-making machine. In order to render the paper sheet useful for writing and resistant to liquid impregnation, improve the paper color, white and tone, increase the transparency of the paper and increase the printing performance of the paper, etc., the paper slurry can undergo sizing, adding filler and staining. Furthermore, various chemical aids can be added to provide the paper with some special properties (for example, enhancing the dry strength, wet strength and eliminating bubbles).

(2) supplying the paper stock to the slurry supply system: the paper stock is supplied into the slurry supply system, undergoes treatments such as storing, screening, purifying, de-slagging, de-sanding, de-gassing, and discharges the metal, nonmetal impurities, fiber bundle, lump and air, etc., so as to avoid the adverse effect on the quality of the paper and hinder the paper-making process. The slurry pass undergoes slurry proportion, dilution, concentration adjustment, dosage and pressure elimination, and then flow into the head box and onto the wire for making paper.

2. The Paper-Making of Paper Comprises:

(1) stock flow approaching: the paper stock is delivered to the forming section (wire section) through the headbox. The headbox is useful in dispersing the fiber homogeneously and flowing the slurry onto the wire smoothly. The additives for paper making, such as the dry strength aids for paper, the wet strength aids for paper, can be added in the process of stock flow approaching.

(2) forming: in the forming section, the paper stock delivered by the forming section is formed into a wet paper web by draining on the wire. The forming section is also referred to as wire section. The dryness of the wet paper web can be in range of from 15% to 25%.

(3) pressing and draining: in the pressing section, the wet paper web from the forming section is subject to a mechanical pressing to form a wet paper sheet. The dryness of the wet paper sheet can be in a range of from 35% to 50%.

The step (d) can be carried out by the above (2) and (3).

(4) drying: in the dryer section, the wet paper sheet from the pressing section is dried with a dry cylinder to form a paper sheet. The dryness of the paper sheet can be in a range of from 92% to 97%.

The step (e) can be carried out by the above (4).

Moreover, the paper sheet can undergo, as required, finishing procedures such as calendering, winding and cutting, paper-sorting or rewinding, packaging, etc., so as to produce the paper sheet into a finished paper in the form of flat or roller. Additionally, in order to improve the quality of the paper sheet, surface sizing, coating and online soft calender or offline supercalender can be carried out in the dryer section.

In the paper-making process, the paper slurry provided by a paper stock preparation system is generally subject to a slurry supply system (undergoing a treatment before the paper stock flows onto the wire), the headbox and the forming section, the press section, dryer section, etc.

The paper-making aid composition is added into the pulp slurry in an amount of between 0.01 kg/ton dry fiber and 50 kg/ton dry fiber, e.g., 0.1 kg/ton dry fiber and 10 kg/ton dry fiber, based on the weight ratio of the sum of the dialdehyde-modified polyacrylamide-type strengthening agent(s) and the polyacrylamide-type strengthening agent(s) relative to the dry fiber in the pulp slurry.

EXAMPLES

The invention is described in more detail by referring to the following Examples and Comparative Examples, but not limited to these Examples.

1. Paper-Making Process and Characterization of Paper (a) Method for Making Hand Sheet The pulp slurry (thick stock) is obtained from a paper mill. The thick stock comprises a mixed slurry of mechanical pulp and deinking pulp, or a cycled waste pulp, as main component. Sheet-making is performed after the thick stock is diluted with tape water or white water from paper-making plant to a concentration of about 0.7%. The electrical conductivity is controlled at about 2.5-3 ms/cm during the whole sheet-making process.

Semi-automatic Tappi standard sheet-making machine, provided by FRANK-PTI Co., is used as sheet-making machine. The specific test method is described in T205 Introduction sp-02. To the diluted pulp, a fixing agent, test additives and retention aids are added successively at a rotation speed of 800 rpm.

The pulp added with the agents is poured into a forming cylinder of paper-making machine and undergoes filtering and forming. Afterwards, the forming cylinder is opened, and a bibulous paper is taken to cover the wet paper sheet which is then covered with a flat clamp to remove part of water. Then the paper sample is transferred to a new bibulous paper which is then covered with stainless steel clamp, onto which a bibulous paper is covered again, the wet paper sample is thus accumulated. When accumulating 5 to 10 paper samples, they are provided in to a special press machine to perform a two-section pressing, further removing water from paper.

The pressed paper is transferred to a constant temperature and humidity lab (50% humidity at 23° C.), and every single paper sample is placed into a special metal ring. Piling up the metal rings and placing a heavy object onto the metal ring where the paper sample lies on. After air drying for 24 hours, the paper sample can be peeled from stainless steel clamp for corresponding test.

(b) Test Method for Internal Bonding Strength

The principle of the internal bond impact tester is to measure the energy required to separate the paper sheet by a mechanical equipment so as to reflect to the magnitude of the internal bonding strength. The measurement of the internal bonding strength is to express the resistant force that is required to overcome for separating the single or multiple fiber layer(s), which is frequently used to discuss the delamination problem of the paper sheet or paperboard. The test method adopted in the experiment comprises the determination of the force applied by a pendulum to splitting the paper along Z-direction. When the fibers of a hand sheet align in X-Y plane, the exhausted energy is mainly used for the bonding of the fiber, and the length of the fiber and the strength of the fiber itself have no influence on the Scott bonding.

The equipment used in the experiment was purchased from PTI company. The test method refers to Tappi T569.

For a test, a paper with a size of around 25.4 mm×200 mm is cut out previously, and then tape and paper sample are attached to a base following a sequence of tape-paper sample-tap, and the double-sided adhesive tape and the paper sample are attached to each other closely by applying a force. Afterwards, a pendulum is released to knock and separate the paper sample when the equipment automatically record the force that is required to separate the bonding of the fiber layers for each time, expressed in kg·cm/in$^2$, J/m$^2$.

(c) Test Method for Burst Index

Burst index refers to maximum pressure on a unit area that paper or paperboard can withstand, normally expressed in kPa.

An L&W burst tester is used in this experiment. The pressure of the tester is controlled as 5 kg. After the paper is inserted into a test tank, the test button is pressed and the glass cover is automatically lowered down. On a LED display is shown the maximum pressure value (kPa) when the paper is torn. The burst index is calculated as follows:

$$X=p/g$$

X—burst index, kPa·m$^2$/g p—burst, kPa g—basis weight of paper, g/m$^2$ (d) Test Method for Ash Content The fiber raw material for paper-making or the paper pulp component itself can contain an amount of mineral matter. During the paper-making process, certain amount of mineral matter can be added in order to save the cost of the fiber raw material. Therefore, after the paper is burned at a high temperature and calcinated, the remaining mineral matter is called as ash.

The determination method for the ash content of paper and paperboard refers to GB/T 463-1989.

A certain amount of paper sample is accurately weighed and placed into a crucible which has been preburned to a constant, and then transferred into a muffle furnace to undergo burning at 550° C. for 1.5 hour. The crucible is taken out and cooled in the air for 5-10 minutes and then transferred to a dryer, cooled and weighed until a constant weight. The calculation formula is as follows:

$$X=(m2-m1)/m\times 100\%$$

m1—mass of crucible after burning, g m2—mass of crucible containing ash after burning, g m—over-dry mass of specimen, g X—ash retention %.

(e) Determination of Viscosity

Brookfield Programmable LVDV-II+viscometer, manufactured by Brookfield Engineering Laboratories, Inc, Middleboro, Mass., is utilized in this experiment.

0-100 cps, measured by Spindle 1 at 60 rpm 100-1000 cps, measured by Spindle 2 at 30 rpm 1000-10000 cps, measured by Spindle 3 at 12 rpm 2. Polyacrylamide-Type Dry Strength Aid The amphoteric polyacrylamide-type dry strengthening agents used in Examples and Comparative Examples were prepared as follows:

(1). Amphoteric Polyacrylamide Copolymer 1 is a Polyacrylamide-type dry strength aid, Nalco TX15951, manufactured and marketed by Nalco. Co.

Profile of Nalco TX15951:

Active Ingredient: Amphoteric Polyacrylamide

Solid Content: 20%

Viscosity: 7,000 cps

PH value: 3.5

Weight average molecular weight: 1,200,000 Dalton (2). Synthesis of Amphoteric Polyacrylamide Copolymer 2

To 2 L reactor, 277 g acrylamide (with a concentration of 40%), 333 g soft water, 6 g itaconic acid, 35 g acryloxyethyldimethyl benzyl ammounium chloride (with a concentration of 80%), 5 g 2-(dimethylamino)ethyl methacrylate, 3 g concentrated hydrochloric acid, 130 g soft water were successively added, and stirred to be homogeneous prior to be purged with nitrogen gas. Thirty minutes later, 7 g 0.45 wt % aqueous solution of N, N-methylene biacrylamide was added. Afterwards, 1.2 g 4.3 wt % aqueous solution of ammonium persulfate and 2.4 g 7.5 wt % aqueous solution of sodium bisulfite were added. Nitrogen gas was purged until the temperature increased 1.5° C. After the temperature was increased to 70° C., the reaction was maintained at this temperature for 6 hours until the reaction was completed. 1.8 g a 5.6 wt % aqueous solution of oxalic acid and 199 g soft water were added with stirring. Continuing stirring for 1 hour to obtain the amphoteric polyacrylamide copolymer 2 with a solid content of 15 wt %, a viscosity of about 5000 cps, a molecular weight of 1,000,000 Dalton.

(3). Synthesis of Amphoteric Polyacrylamide Copolymer 3

To 2 L reactor, 297 g acrylamide (with a concentration of 40%), 323 g soft water, 6 g itaconic acid, 25 g acryloxyethyldimethyl benzyl ammounium chloride (with a concentration of 80%), 6 g 2-(dimethylamino)ethyl methacrylate, 3 g concentrated hydrochloric acid, 130 g soft water were successively added, and stirred to be homogeneous prior to be purged with nitrogen gas. Thirty minutes later, 7 g 0.45 wt % aqueous solution of N,N-methylene biacrylamide was added. Afterwards, 1.2 g 4.3 wt % aqueous solution of ammonium persulfate and 2.4 g 7.5 wt % aqueous solution of sodium bisulfite were added. Nitrogen gas was purged until the temperature increased 1.5° C. After the temperature was increased to 70° C., the reaction was maintained at this temperature for 6 hours until the reaction was completed. 1.8 g 5.6 wt % aqueous solution of oxalic acid and 199 g soft water were added with stirring. Continuing stirring for 1 hour to obtain the amphoteric polyacrylamide copolymer 3 with a solid content of 15 wt %, a viscosity of about 5000 cps, a molecular weight of 1,100,000 Dalton.

(4). Synthesis of Cationic Polyacrylamide Copolymer 4

To a 2 L three-necked flask with a heating and a condensation tube, 615.35 g soft water, 0.1 g ethylenediamine tetraacetic acid (EDTA) and 143.24 g diallyldimethylammonium chloride (DADMAC) (with a concentration of 62%) were added. An initiator comprising 0.3 g ammonium persulfate and 30 g soft water was added once the obtained solution was heated to 90° C. The addition of a solution comprising 199.86 g acrylamide (with a concentration of 62%), 4.08 g N,N-dimethyl formide and 7.07 g N-(3-dimethylaminopropyl)methacrylamide was started after adding the initiator for 2 minutes. The addition took 2 hours to complete. The temperature was maintained at 90° C. for 1 hour to obtain the amphoteric polyacrylamide copolymer 4 with a solid content of 20 wt %, a viscosity of about 10,700 cps, a molecular weight of 900,000 Dalton.

3. Glyoxylated Polyacrylamide-Type Dry Strengthening Agent (GPAM Copolymer Solution)

The GPAMs used in the examples were prepared as follows.

(1). Synthesis of base polymer 1 (intermediate 1)

To a 2 L three-neck flask with a heating and a cooling tube, 90 g soft water, 0.1 g ethylenediamine tetraacetic acid (EDTA) and 160 g diallyldimethylammonium chloride (DADMAC) were added. An initiator comprising 4 g ammonium persulfate and 16 g soft water was added once the obtained solution was heated to 100° C. and the addition took 137 minutes to complete. The addition of monomer phase containing 625 g acrylamide (concentration 50%) was started after adding the initiator for 2 minutes. The addition of monomer phase took 120 minutes to complete. After completing the addition of the initiator, the solution was incubated at 100° C. The reaction ended in 1 hour, affording an intermediate with a solid content of 41 wt % and a viscosity of 2000 cps.

(2). Synthesis of Base Polymer 2 (Intermediate 2)

To a 2 L three-neck flask with a heating and a cooling tube, 90 g soft water, 0.1 g ethylenediamine tetraacetic acid (EDTA) and 64 g diallyldimethylammonium Chloride (DADMAC) were added. An initiator comprising 4 g ammonium persulfate and 16 g soft water was added once the obtained solution was heated to 100° C. and the addition took 137 minutes to complete. The addition of monomer phase containing 743 g acrylamide (concentration 50%) was started after adding the initiator for 2 minutes. The addition of monomer phase took 120 minutes to complete. After completing the addition of the initiator, the solution was incubated at 100° C. The reaction ended in 1 hour, affording an intermediate with a solid content of 41 wt % and a viscosity of 1000 cps.

(3). Synthesis of Base Polymer 3 (Intermediate 3)

To a 2 L three-neck flask with a heating and a cooling tube, 168.98 g soft water, 16.25 g 48% sodium hydride, 26.27 g 75% phosphoric acid, 7.6 g sodium formate, and 0.1 g ethylenediamine tetraacetic acid (EDTA) were added. An initiator comprising 4 g ammonium persulfate and 16 g soft water was added once the obtained solution was heated to 100° C. and the addition took 130 minutes to complete. The addition of a mixed solution containing 713.4 g acrylamide (concentration 50%) and 49.8 g acrylic acid was started after adding the initiator for 2 minutes. The addition took 120 minutes to complete. After completing the addition of the initiator, the solution was incubated at 100° C. The reaction ended in 2 hour, affording an intermediate with a solid content of 41 wt % and a viscosity of 1440 cps.

(4). Synthesis of Base Polymer 4 (Intermediate 4)

To a 2 L three-neck flask with a heating and a cooling tube, 200.78 g soft water, 16.25 g 48% sodium hydride, 26.27 g 75% phosphoric acid, 7.6 g sodium formate, 0.1 g ethylenediamine tetraacetic acid (EDTA) and 109.4 g diallyldimethylammonium chloride (DADMAC) were added. An initiator comprising 4.4 g ammonium persulfate and 13.2 g soft water was added once the obtained solution was heated to 100° C. and the addition took 130 minutes to complete. The addition of a mixed solution containing 609.5 g acrylamide (concentration 50%) and 12.5 g acrylic acid was started after adding the initiator for 2 minutes. The addition took 120 minutes to complete. After completing the addition of the initiator, the solution was incubated at 100° C. The reaction ended in 2 hour, affording an intermediate with a solid content of 39 wt % and a viscosity of 530 cps.

(5). Synthesis of Glyoxylated Cationic Polyacrylamide-Type Copolymer 1 (GPAM Copolymer Solution 1)

To a 2 L glass container, 727 g soft water, 195 g the above base polymer 1 and 49 g 40% solution of glyoxal were separately added and mixed at 25° C. for 15 minutes. The pH value of the obtained solution was adjusted to 8.4 with a 48% sodium hydroxide solution. During the reaction, samples were taken for the determination of the viscosity until a product with a viscosity of 18 cps was obtained. The obtained product was adjusted with a 50% sulfuric acid until pH value is 3, affording a polymer having a solid content of 10 wt % and a molecular weight of 1,200,000 Dalton. The final product was marked with "GPAM copolymer solution 1".

(6). Synthesis of Glyoxylated Cationic Polyacrylamide-Type Copolymer 2 (GPAM Copolymer Solution 2)

To a 2 L glass container, 605 g soft water, 341 g the above base polymer 2 and 26 g 40% solution of glyoxal were separately added and mixed at 25° C. for 15 minutes. The pH value of the obtained solution was adjusted to 8.4 with a 48% sodium hydroxide solution. During the reaction, samples were taken for the determination of the viscosity until a product with a viscosity of 32 cps was obtained. The obtained product was adjusted with a 50% sulfuric acid until pH value is 3, affording a polymer having a solid content of 15 wt % and a molecular weight of 1,000,000 Dalton. The final product was marked with "GPAM copolymer solution 2".

(7). Synthesis of Glyoxylated Anionic Polyacrylamide-Type Copolymer 3 (GPAM Copolymer Solution 3)

To a 2 L glass container, 732.54 g soft water and 205.5 g the above base polymer 3 were added, and the obtained solution was adjusted to have a pH value of about 9 with 4.86 g 48% sodium hydroxide. Then, 50.3 g 40% glyoxol was added, and the pH value was adjusted to about 8.5 with 6.8 g 5% sodium hydroxide. The reaction was carried out at a normal temperature, and a viscometer was used to monitor the viscosity of the reaction solution. When the reactant reached a viscosity of 18 cps, 50% sulfuric acid was added to adjust the pH value of the product to be 3, so as to obtain a polymer having a solid content of 10 wt % and a molecular weight of 1,200,000 Dalton. The final product was marked with "GPAM copolymer solution 3".

(8). Synthesis of Glyoxylated Amphoteric Polyacrylamide-Type Copolymer 4 (GPAM Copolymer Solution 4)

To a 2 L glass container, 732.63 g soft water and 205.5 g the above base polymer 4 were added, and the obtained solution was adjusted to have a pH value of about 9 with 4.07 g 48% sodium hydroxide. Then, 50.3 g 40% glyoxol was added, and the pH value was adjusted to about 8.5 with 7.5 g 5% sodium hydroxide. The reaction was carried out at a normal temperature, and a viscometer was used to monitor the viscosity of the reaction solution. When the reactant reached a viscosity of 18 cps, 50% sulfuric acid was added to adjust the pH value of the product to be 3, so as to obtain a polymer having a solid content of 10 wt % and a molecular weight of 1,000,000 Dalton. The final product was marked with "GPAM copolymer solution 4".

Example 1

GPAM copolymer solution 1 was pre-mixed with the amphoteric polyacrylamide copolymer 1 in a ratio of 1:1 (w/t). The obtained solution was diluted 10 times by the addition of the ionized water. The diluted pre-mixed solution was adjusted to have a pH value of 6.8 with a 24% aqueous solution of sodium hydroxide. After adjusting the pH value, the premixed solution was used as test additive in two dosages (3 kg/ton or 6 kg/ton) in the preparation of the hand sheet samples 1A and 1B of the invention according to the hand sheet preparation method described above. The thick stock used in the Example was mixed slurry of mechanical slurry and deinked slurry. In the Example, a dual retention aid (0.4 kg/ton of Nalco 61067 and 2.0 kg/ton of bentonite) was used as retention aid.

It should be noted that the dosage herein refers to the amount of the active ingredient in the solution (agent) relative to the dry fiber in the pulp slurry. The meaning of dosage is valid below.

Example 2

GPAM copolymer solution 1 was pre-mixed with the amphoteric polyacrylamide copolymer 1 in a ratio of 1:1 (w/t). The obtained solution was diluted 10 times by the addition of the ionized water. The diluted pre-mixed solution was adjusted to have a pH value of 7.5 with a 24% aqueous solution of sodium hydroxide. After adjusting the pH value, the premixed solution was used as test additive in two dosages (3 kg/ton or 6 kg/ton) in the preparation of the hand sheet samples 2A and 2B of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Example 3

GPAM copolymer solution 1 was pre-mixed with the amphoteric polyacrylamide copolymer 1 in a ratio of 1:1 (w/t). The obtained solution was diluted 10 times by the addition of the ionized water. The diluted pre-mixed solution was adjusted to have a pH value of 9.6 with a 24% aqueous solution of sodium hydroxide. After adjusting the pH value, the premixed solution was used as test additive in two dosages (1.5 kg/ton or 3.0 kg/ton) in the preparation of the hand sheet samples 3A and 3B of the invention according to the hand sheet preparation method described above. The thick stock used in the Example was mixed slurry of mechanical slurry and deinked slurry. In the Example, a dual retention aid (0.2 kg/ton of Nalco 61067 and 1.0 kg/ton of bentonite) was used as retention aid.

Example 4

GPAM copolymer solution 1 was pre-mixed with the amphoteric polyacrylamide copolymer 2 in a ratio of 1:1 (w/t). The obtained solution was diluted 10 times by the addition of the ionized water. The diluted pre-mixed solution was adjusted to have a pH value of 7.8 with a 24% aqueous solution of sodium hydroxide. After adjusting the pH value, the premixed solution was used as test additive in two dosages (3.1 kg/ton or 6.3 kg/ton) in the preparation of the hand sheet samples 4A and 4B of the invention according to the hand sheet preparation method described above. The thick stock used in the Example was mixed slurry of mechanical slurry and deinked slurry. In the Example, a dual retention aid (0.2 kg/ton of Nalco 61067 and 2.0 kg/ton of bentonite) was used as retention aid.

Example 5

GPAM copolymer solution 3 was pre-mixed with the amphoteric polyacrylamide copolymer 4 in a ratio of 2:1 (w/t). The obtained solution was diluted 17 times by the addition of the ionized water. The diluted pre-mixed solution was adjusted to have a pH value of 8.5 and 9.6, respectively, with a 24% aqueous solution of sodium hydroxide. After adjusting the pH value, the premixed solution with the pH value of 8.5 was used as test additive in two dosages (1.5 kg/ton or 3.0 kg/ton) in the preparation of the hand sheet samples 5A and 5B of the invention according to the hand sheet preparation method described above; the premixed solution with the pH value of 9.6 was used as test additive in two dosages (1.5 kg/ton or 3.0 kg/ton) in the preparation of the hand sheet samples 6A and 6B of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Example 6

GPAM copolymer solution 4 was pre-mixed with the amphoteric polyacrylamide copolymer 1 in a ratio of 1:1 (w/t). The obtained solution was diluted 20 times by the addition of the ionized water. The diluted pre-mixed solution was adjusted to have a pH value of 8.1 with a 24% aqueous solution of sodium hydroxide. After adjusting the pH value, the premixed solution was used as test additive in two dosages (1.5 kg/ton or 3.0 kg/ton) in the preparation of the hand sheet samples 6A and 6B of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Example 7

GPAM copolymer solution 2 was pre-mixed with the amphoteric polyacrylamide copolymer 3 in a ratio of 3:1 (w/t). The obtained solution was diluted 20 times by the addition of the ionized water. The diluted pre-mixed solution was adjusted to have a pH value of 9.3 with a 24% aqueous solution of sodium hydroxide. After adjusting the pH value, the premixed solution was used as test additive in two dosages (1.5 kg/ton or 3.0 kg/ton) in the preparation of the hand sheet samples 7A and 7B of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Comparative Example 1

GPAM copolymer solution 1 was pre-mixed with the amphoteric polyacrylamide copolymer 1 in a ratio of 1:1 (w/t). The obtained solution was diluted 10 times by the addition of the ionized water. At this time, the pH value of the pre-mixed solution was measured as pH 3.5. The diluted, premixed solution was used as test additive in two dosages (3 kg/ton or 6 kg/ton) in the preparation of the hand sheet samples 1a and 1b of the invention according to the hand sheet preparation method described above. The thick stock used in the Example was mixed slurry of mechanical slurry and deinked slurry. In the Example, a dual retention aid (0.4 kg/ton of Nalco 61067 and 2.0 kg/ton of bentonite) was used as retention aid.

Comparative Example 2

GPAM copolymer solution 1 was pre-mixed with the amphoteric polyacrylamide copolymer 1 in a ratio of 1:1 (w/t). The obtained solution was diluted 10 times by the addition of the ionized water. At this time, the pH value of the pre-mixed solution was measured as pH 3.7. The diluted, premixed solution was used as test additive in two dosages (3 kg/ton or 6 kg/ton) in the preparation of the hand sheet samples 2a and 2b of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Comparative Example 3

GPAM copolymer solution 1 was pre-mixed with the amphoteric polyacrylamide copolymer 1 in a ratio of 1:1 (w/t). The obtained solution was diluted 10 times by the addition of the ionized water. At this time, the pH value of the pre-mixed solution was measured as pH 3.5. The diluted, premixed solution was used as test additive in two dosages (1.5 kg/ton or 3.0 kg/ton) in the preparation of the hand sheet samples 3a and 3b of the invention according to the hand sheet preparation method described above. The thick stock used in the Example was mixed slurry of mechanical slurry and deinked slurry. In the Example, a dual retention aid (0.2 kg/ton of Nalco 61067 and 1.0 kg/ton of bentonite) was used as retention aid.

Comparative Example 4

GPAM copolymer solution 1 was pre-mixed with the amphoteric polyacrylamide copolymer 2 in a ratio of 1:1 (w/t). The obtained solution was diluted 10 times by the addition of the ionized water. At this time, the pH value of the pre-mixed solution was measured as pH 4.2. The diluted, premixed solution was used as test additive in two dosages (3.1 kg/ton or 6.3 kg/ton) in the preparation of the hand sheet samples 4a and 4b of the invention according to the hand sheet preparation method described above. The thick stock used in the Example was mixed slurry of mechanical slurry and deinked slurry. In the Example, 15 kg/ton of 50 wt % aqueous aluminum sulfate solution was used as fixing agent, and a dual retention aid (0.2 kg/ton of Nalco 61067 and 2.0 kg/ton of bentonite) was used as retention aid.

Comparative Example 5

GPAM copolymer solution 3 was pre-mixed with the amphoteric polyacrylamide copolymer 4 in a ratio of 2:1 (w/t). The obtained solution was diluted 17 times by the addition of the ionized water. At this time, the pH value of the pre-mixed solution was measured as pH 3.5. The diluted, premixed solution was used as test additive in two dosages (1.5 kg/ton or 3.0 kg/ton) in the preparation of the hand sheet samples 5a and 5b of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Comparative Example 6

GPAM copolymer solution 4 was pre-mixed with the amphoteric polyacrylamide copolymer 1 in a ratio of 1:1 (w/t). The obtained solution was diluted 17 times by the addition of the ionized water. At this time, the pH value of the pre-mixed solution was measured as pH 3.5. The diluted, premixed solution was used as test additive in two dosages (1.5 kg/ton or 3.0 kg/ton) in the preparation of the hand sheet samples 6a and 6b of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

Comparative Example 7

GPAM copolymer solution 2 was pre-mixed with the amphoteric polyacrylamide copolymer 3 in a ratio of 3:1 (w/t). The obtained solution was diluted 20 times by the addition of the ionized water. At this time, the pH value of the pre-mixed solution was measured as pH 3.8. The diluted, premixed solution was used as test additive in two dosages (1.5 kg/ton or 3.0 kg/ton) in the preparation of the hand sheet samples 7a and 7b of the invention according to the hand sheet preparation method described above. The thick stock used in the Example was mixed slurry of mechanical slurry and deinked slurry. In the Example, a dual retention aid (0.3 kg/ton of Nalco 61067 and 1.5 kg/ton of bentonite) was used as retention aid.

According to the described methods, internal bonding strength or burst index and ash retention of the above hand sheet samples were measured. The results are shown in the following Table 1:

TABLE 1

Internal bonding strength or Burst Index, and Asch Retention

| Hand Sheet Sample Pulp Slurry Batch 1* | Internal Bonding Strength kg · cm/in$^2$ | Ash Retention of Paper % |
|---|---|---|
| 1A | 2.515 | 11.64 |
| 1B | 2.882 | 11.87 |
| 1a | 2.555 | 10.78 |
| 1b | 2.875 | 11.58 |
| Blank | 1.964 | 7.72 |
| **Hand Sheet Sample Pulp Slurry Batch 2*** | **Internal Bonding Strength kg · cm/in$^2$** | **Ash Retention of Paper %** |
| 2A | 0.701 | 16.82 |
| 2B | 0.984 | 17.48 |
| 2a | 0.664 | 15.44 |
| 2b | 0.810 | 15.72 |
| Blank | 0.547 | 14.01 |
| **Hand Sheet Sample Pulp Slurry Batch 3*** | **Internal Bonding Strength kg · cm/in$^2$** | **Ash Retention of Paper %** |
| 3A | 0.890 | 20.34 |
| 3B | 0.926 | 20.62 |

TABLE 1-continued

| Internal bonding strength or Burst Index, and Asch Retention | | |
|---|---|---|
| 3a | 0.821 | 17.65 |
| 3b | 0.812 | 16.69 |
| Blank | 0.707 | 18.61 |
| Hand Sheet Sample Pulp Slurry Batch 4* | Burst Index kPa · $m^2/g$ | Ash Retention of Paper % |
| 4A | 2.314 | 7.88 |
| 4B | 2.507 | 7.89 |
| 4a | 2.269 | 7.77 |
| 4b | 2.428 | 7.77 |
| Blank | 1.980 | 7.15 |
| Hand Sheet Sample Pulp Slurry Batch 5* | Internal Bonding Strength kg · $cm/in^2$ | Ash Retention of Paper % |
| 5A | 0.570 | 5.18 |
| 5B | 0.752 | 5.36 |
| 5C | 0.562 | 5.31 |
| 5D | 0.709 | 5.45 |
| 6A | 0.510 | 4.13 |
| 6B | 0.614 | 4.29 |
| 7A | 0.510 | 3.63 |
| 7B | 0.553 | 3.74 |
| 5a | 0.524 | 5.04 |
| 5b | 0.625 | 5.02 |
| 6a | 0.509 | 3.95 |
| 6b | 0.554 | 4.09 |
| 7a | 0.470 | 3.31 |
| 7b | 0.519 | 3.29 |
| Blank | 0.437 | 3.87 |

It can be seen from Table 1 that, as for Pulp Slurry Batch 1, Hand Sheet Samples 1A and 1B (with the pH value being adjusted to 6.8) show an comparable internal bonding strength but an improved ash content, as compared with Hand Sheet Samples 1a and 1b (without adjusting the pH value). As for Pulp Slurry Batch 2, Hand Sheet Samples 2A and 2B (with the pH value being adjusted to 7.5) show an improved internal bonding strength and an improved ash content, as compared with Hand Sheet Samples 2a and 2b (without adjusting the pH value). As for Pulp Slurry Batch 3, Hand Sheet Samples 3A and 3B (with the pH value being adjusted to 9.6) are largely improved both in the internal bonding strength and in the ash content, as compared with Hand Sheet Samples 3a and 3b (without adjusting the pH value). As for Pulp Slurry Batch 4, Hand Sheet Samples 4A and 4B (with the pH value being adjusted to 7.8) are improved in the burst index and the ash content, as compared with Hand Sheet Samples 4a and 4b (without adjusting the pH value). As for Pulp Slurry Batch 5, Hand Sheet Samples 5A and 5B (with the pH value being adjusted to 8.5) as well as 5C and 5D (with the pH value being adjusted to 9.6) are largely improved both in the internal bonding strength and in the ash content, as compared with Hand Sheet Samples 5a and 5b (without adjusting the pH value). Hand Sheet Samples 6A and 6B (with the pH value being adjusted to 8.1) are largely improved both in the internal bonding strength and in the ash content, as compared with Hand Sheet Samples 6a and 6b (without adjusting the pH value). Hand Sheet Samples 7A and 7B (with the pH value being adjusted to 9.3) are improved largely both in the internal bonding strength and in the ash content, as compared with Hand Sheet Samples 6a and 6b (without adjusting the pH value). It indicates that, as compared with a composition which is not subject to a pH adjustment, the adjustment of the pH value will result in an increase in the ash content as well as an enhancement in the strength of the paper.

The aforementioned are merely exemplary embodiments of the invention, rather than limiting the scope of the invention which is determined by the appended claims.

The invention claimed is:

1. A paper-making aid composition comprising dialdehyde-modified polyacrylamide-type strengthening agent, polyacrylamide-type strengthening agent and water;

the dialdehyde-modified polyacrylamide-type strengthening agent is selected from cationic dialdehyde-modified polyacrylamide-type strengthening agent, anionic dialdehyde-modified polyacrylamide-type strengthening agent and amphoteric dialdehyde-modified polyacrylamide-type strengthening agent;

the polyaerylamide-type strengthening agent is selected from cationic polyacrylamide-type strengthening agent, anionic polyacrylamide-type strengthening agent and amphoteric polyacrylamide-type strengthening agent;

wherein the paper-making aid composition has a pH value of 6 or above;

and the following are excluded:

(A) all of the dialdehyde-modified polyacrylamide-type strengthening agent is cationic dialdehyde-modified polyacrylamide-type strengthening agent, and all of the polyacrylamide-type strengthening agent is cationic polyacrylamide type strengthening agent, and (B) all of the dialdehyde-modified polyacrylamide-type strengthening agent is anionic dialdehyde-modified polyacrylamide-type strengthening agent, and all of the polyacrylamide-type strengthening agent is anionic polyacrylamide-type strengthening agents.

2. The paper-making aid composition of claim 1, wherein:

the cationic dialdehyde-modified polyacrylamide-type strengthening agent is dialdehyde-modified copolymer comprising acrylamide monomer and cationic monomer;

the anionic dialdehyde-modified polyacrylamide-type strengthening agent is dialdehyde-modified copolymer comprising acrylamide monomer and anionic monomer;

the amphoteric dialdehyde-modified polyacrylamide-type strengthening agent is dialdehyde-modified copolymer comprising acrylamide monomer, cationic monomer and anionic monomer.

3. The paper-making aid composition of claim 2, wherein the dialdehyde is selected from glyoxal, malonaldehyde, succinic aldehyde, glutaraldehyde, and combinations thereof.

4. The paper-making aid composition of claim 3, wherein the dialdehyde of any one of the dialdehyde-modified copolymers is glyoxal.

5. The paper-making aid composition of claim 2, wherein the cationic monomer of the dialdehyde-modified polyacrylamide-type strengthening agent is selected from diallyldimethylammonium chloride, N-(3-dimethylaminopropyl) methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammounium chloride, acryloxyethyldimethyl benzyl ammounium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, and combinations thereof.

6. The paper-making aid composition of claim 2, wherein the anionic monomer is selected from acrylic acid, methacrylic acid, itaconic acid, maleic acid, maleic anhydride, salts thereof, and combinations thereof.

7. The paper-making aid composition of claim 2, wherein the acrylamide monomer is at least one of acrylamide and methacrylamide.

8. The paper-making aid composition of claim 1, wherein the dialdehyde-modified polyacrylamide-type strengthening agent has a weight average molecular weight of 100,000-40,000,000 Dalton.

9. The paper-making aid composition of claim 1, wherein the cationic polyacrylamide-type strengthening agent is a copolymer comprising acrylamide monomer and cationic monomer;

the anionic polyacrylamide-type strengthening agent is a copolymer comprising acrylamide monomer and anionic monomer;

the amphoteric polyacrylamide-type strengthening agent is a copolymer comprising acrylamide monomer, cationic monomer and anionic monomer.

10. The paper-making aid composition of claim 9, wherein the cationic monomer is selected from diallyldimethylammonium chloride, N-(3-dimethylaminopropyl) methacrylamide, N-(3-dimethylaminopropyl) acrylamide, trimethyl-2 methacroyloxyethylammonium chloride, trimethyl-2-acroyloxyethyl ammonium chloride, methylacryloxyethyldimethyl benzyl ammounium chloride, acryloxyethyldimethyl benzyl ammounium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, and combinations thereof.

11. The paper-making aid composition of claim 9, wherein the anionic monomer is selected from acrylic acid, methacrylic acid, itaconic acid, maleic acid, maleic anhydride, salts thereof, and combinations thereof.

12. The paper-making aid composition of claim 1, wherein the polyacrylamide-type strengthening agent has a weight average molecular weight of 100,000-10,000,000 Dalton.

13. The paper-making aid composition of claim 1, wherein the total solid content of the polyacrylamide-type strengthening agent in the paper-making aid composition is from 0.1 to 60 wt %.

14. The paper-making aid composition of claim 1, wherein the ratio of the solid content of the dialdehyde-modified polyacrylamide-type strengthening agent to the solid content of the polyacrylamide-type strengthening agent is from 1:99 to 99:1.

15. The paper-making aid composition of claim 1, wherein the paper-making aid composition has a pH of from about 8 to about 10.

16. The paper-making aid composition of claim 1, wherein the paper-making aid composition has a pH of from about 6.5 to about 13.

17. The paper-making aid composition of claim 1, wherein the paper-making aid composition has a pH of from about 7 to about 12.

18. The paper-making aid composition of claim 1, wherein the paper-Making aid composition has a of from about 7.5 to about 11.

19. The paper-making aid composition of claim 1, wherein the paper making aid composition has a molar ratio of cationic monomers to anionic monomers of from 1:100 to 100:1.

20. The papermaking aid composition of claim 19, wherein the molar ratio of cationic monomers to anionic monomers is from 1:10 to 10:1.

* * * * *